US010316614B2

(12) United States Patent
Fripp et al.

(10) Patent No.: US 10,316,614 B2
(45) Date of Patent: Jun. 11, 2019

(54) WELLBORE ISOLATION DEVICES WITH SOLID SEALING ELEMENTS

(71) Applicant: Halliburton Energy Services, Inc., Houston, TX (US)

(72) Inventors: Michael Linley Fripp, Carrollton, TX (US); John Charles Gano, Lowery Crossing, TX (US); Zachary Murphree, Dallas, TX (US); Zachary Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 525 days.

(21) Appl. No.: 14/763,228

(22) PCT Filed: Sep. 4, 2014

(86) PCT No.: PCT/US2014/054031
§ 371 (c)(1),
(2) Date: Jul. 24, 2015

(87) PCT Pub. No.: WO2016/036371
PCT Pub. Date: Mar. 10, 2016

(65) Prior Publication Data
US 2016/0273299 A1 Sep. 22, 2016

(51) Int. Cl.
*E21B 33/128* (2006.01)
*E21B 33/134* (2006.01)
*E21B 33/00* (2006.01)

(52) U.S. Cl.
CPC ..... *E21B 33/128* (2013.01); *E21B 33/134* (2013.01); *E21B 2033/005* (2013.01)

(58) Field of Classification Search
CPC . E21B 33/128; E21B 33/134; E21B 2033/005
See application file for complete search history.

(56) References Cited

U.S. PATENT DOCUMENTS 4,281,840 A 8/1981 Harris
4,406,469 A * 9/1983 Allison ..... E21B 33/1208 277/342

(Continued)

FOREIGN PATENT DOCUMENTS

WO 2012045168 A1 4/2012

OTHER PUBLICATIONS

International Search Report and Written Opinion for PCT/US2014/054031 dated Jun. 10, 2015.

*Primary Examiner* — Shane Bomar
*Assistant Examiner* — Steven A MacDonald
(74) *Attorney, Agent, or Firm* — McGuireWoods LLP

(57) ABSTRACT

An example wellbore isolation device includes a mandrel and one or more solid sealing elements disposed about the mandrel and plastically deformable to seal against an inner wall of a casing or an inner wall of a wellbore. A slip wedge is disposed about the mandrel on a first axial end of the one or more solid sealing elements, and a radial shoulder positioned on the mandrel at a second axial end of the one or more sealing elements. At least the slip wedge applies a compressive force on the one or more solid sealing elements and thereby plastically deforms the one or more solid sealing elements into sealing engagement with the inner wall of the casing or the wellbore.

18 Claims, 6 Drawing Sheets

(56) References Cited

U.S. PATENT DOCUMENTS

| | | | | |
|---|---|---|---|---|
| 4,441,721 | A | 4/1984 | Harris et al. | |
| 4,573,537 | A * | 3/1986 | Hirasuna | E21B 33/1292 166/134 |
| 4,719,971 | A | 1/1988 | Owens | |
| 5,333,692 | A | 8/1994 | Baugh et al. | |
| 5,433,269 | A * | 7/1995 | Hendrickson | E21B 33/1208 166/134 |
| 5,709,269 | A * | 1/1998 | Head | E21B 17/06 166/120 |
| 5,988,276 | A | 11/1999 | Oneal | |
| 6,123,148 | A | 9/2000 | Oneal | |
| 6,962,206 | B2 | 11/2005 | Hirth et al. | |
| 7,165,622 | B2 | 1/2007 | Hirth et al. | |
| 7,703,542 | B2 | 4/2010 | O'Connor et al. | |
| 2008/0061510 | A1* | 3/2008 | Li | E21B 33/00 166/382 |
| 2010/0327532 | A1 | 12/2010 | Thomson | |
| 2012/0055667 | A1 | 3/2012 | Ingram et al. | |
| 2012/0118561 | A1 | 5/2012 | Frazier | |
| 2013/0025849 | A1 | 1/2013 | Richard et al. | |
| 2013/0186621 | A1* | 7/2013 | Shaikh | E21B 34/14 166/264 |
| 2013/0300066 | A1* | 11/2013 | Xu | E21B 33/12 277/336 |
| 2015/0285026 | A1* | 10/2015 | Frazier | E21B 33/1291 166/120 |

* cited by examiner

WELLBORE ISOLATION DEVICES WITH SOLID SEALING ELEMENTS

BACKGROUND

Downhole tools used in the oil and gas industry and, more particularly, to wellbore isolation devices that use solid sealing elements are described herein.

In the drilling, completion, and stimulation of hydrocarbon-producing wells, a variety of downhole tools are used. For example, it is often desirable to seal portions of a wellbore targeted for treatment. For example, during fracturing operations, various fluids and slurries are pumped from the surface into the casing string and forced out into a surrounding subterranean formation, but only certain desired zones of interest should receive the fracturing fluid. It thus becomes necessary to seal the wellbore and thereby provide zonal isolation to target the treatment to the desired zone. Wellbore isolation devices, such as packers, bridge plugs, and fracturing plugs (i.e., "frac" plugs) are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

After the desired downhole operation is complete, the seal formed by the wellbore isolation device must be broken and the tool itself removed from the wellbore. Removing the wellbore isolation device may allow hydrocarbon production operations to commence without being hindered by the presence of the downhole tool. Removing wellbore isolation devices, however, is traditionally accomplished by a complex retrieval operation that involves milling or drilling out a portion of the wellbore isolation device, and subsequently mechanically retrieving its remaining portions. To accomplish this, a tool string having a mill or drill bit attached to its distal end is introduced into the wellbore and conveyed to the wellbore isolation device to mill or drilling out the wellbore isolation device. After drilling out the wellbore isolation device, the remaining portions of the wellbore isolation device may be grasped onto and retrieved back to the surface with the tool string for disposal. As can be appreciated, this retrieval operation can be a costly and time-consuming process.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Downhole tools used in the oil and gas industry and, more particularly, to wellbore isolation devices that use solid sealing elements are described herein.

The embodiments described herein provide wellbore isolation devices that include solid sealing elements to seal and isolate portions of a wellbore. The solid sealing elements may be made of metal or plastic and therefore provide various advantages over traditional elastomeric or rubber sealing elements. For instance, the solid sealing elements described herein are able to provide a seal across a much shorter axial span within the wellbore, which may allow the wellbore isolation device to be axially shorter. The sealing engagement of the solid sealing elements against a casing, for example, may also serve as a slip for the wellbore isolation device since setting the solid sealing elements may result in indentation into the inner wall of the casing, and thereby increasing the frictional engagement. Moreover, the material of the solid sealing elements does not creep or flow as rubber or elastomeric sealing elements tend to do in wellbore environments. As a result, the solid sealing elements may be used in elevated temperature operations where traditional elastomeric or rubber sealing elements would not be suitable. The solid sealing elements may be made of degradable or non-degradable materials.

Figure 1:
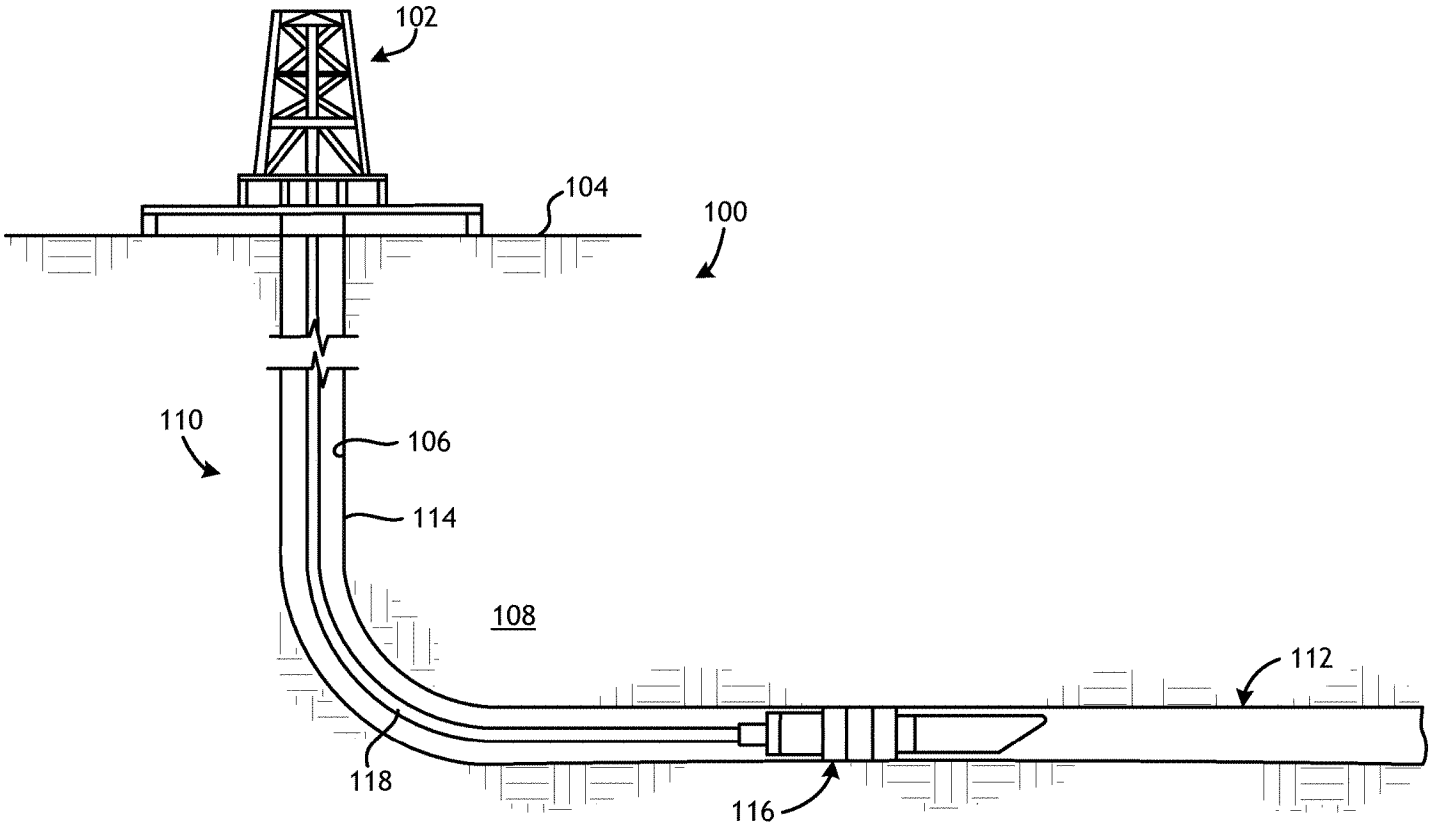
FIG. 1 illustrates a well system that can employ one or more principles of the present disclosure, according to one or more embodiments.

Referring to FIG. 1, illustrated is a well that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. The wellbore isolation device 116 may include or otherwise comprise any type of casing or borehole isolation device known to those skilled in the art including, but not limited to, a frac plug, a bridge plug, a wellbore packer, a wiper plug, a cement plug, or any combination thereof. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location (not shown) within the wellbore 106. At the target location, the wellbore isolation device may be actuated or "set" to seal the wellbore 106 and otherwise provide a point of fluid isolation within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and may provide power to actuate and set the wellbore isolation device 116 upon reaching the target location. In other embodiments, the wellbore isolation device 116 freely falls to the target location under the force of gravity to traverse all or part of the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

Figure 2:
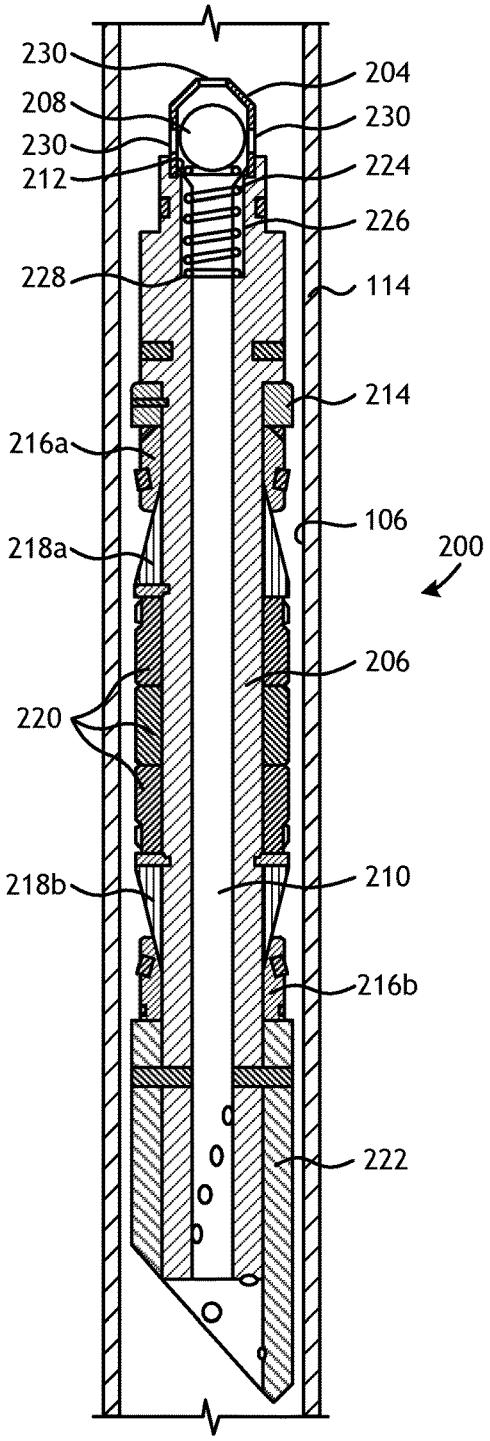
FIG. 2 illustrates a cross-sectional view of an exemplary wellbore isolation device that can employ one or more principles of the present disclosure, according to one or more embodiments.

Referring now to FIG. 2, with continued reference to FIG. 1, illustrated is a cross-sectional view of an exemplary wellbore isolation device 200 that may employ one or more of the principles of the present disclosure, according to one or more embodiments. The wellbore isolation device 200 may be similar to or the same as the wellbore isolation device 116 of FIG. 1. Accordingly, the wellbore isolation device 200 may be configured to be extended into and seal the wellbore 106 at a target location, and thereby prevent fluid flow past the wellbore isolation device 200 for wellbore completion and/or stimulation operations. As illustrated, the wellbore 106 may be lined with the casing 114 or another type of wellbore liner or tubing in which the wellbore isolation device 200 may suitably be set.

The wellbore isolation device 200 is generally depicted and described herein as a hydraulic frac plug. It will be appreciated by those skilled in the art, however, that the principles of this disclosure may equally be applied to any of the other aforementioned types of casing or borehole isolation devices, without departing from the scope of the disclosure. Indeed, the wellbore isolation device 200 may be any of a frac plug, a bridge plug, a wellbore packer, an open hole packer, a wiper plug, a cement plug, or any combination thereof in keeping with the principles of the present disclosure.

As illustrated, the wellbore isolation device 200 may include a ball cage 204 extending from or otherwise coupled to the upper end of a mandrel 206. A sealing or "frac" ball 208 is disposed in the ball cage 204 and the mandrel 206 defines a longitudinal central flow passage 210. The mandrel 206 also defines a ball seat 212 at its upper end. In other embodiments, the ball cage 204 may be omitted and the ball 208 may alternatively be run into the hole at a different time than the rest of the wellbore isolation device 200. One or more spacer rings 214 (one shown) may be secured to the mandrel 206 and otherwise extend thereabout. The spacer ring 214 provides an abutment, which axially retains a set of upper slips 216*a* that are also positioned circumferentially about the mandrel 206. As illustrated, a set of lower slips 216*b* may be arranged distally from the upper slips 216*a*.

One or more slip wedges 218 (shown as upper and lower slip wedges 218*a* and 218*b*, respectively) may also be positioned circumferentially about the mandrel 206, and one or more solid sealing elements 220 may be disposed between the upper and lower slip wedges 218*a,b* and otherwise arranged about the mandrel 206. In some embodiments, one of the upper and lower slip wedges 218*a*, may be replaced with a radial shoulder (not shown) provided by the mandrel 206. In such embodiments, one end of the solid sealing elements 220 may bias and otherwise engage the radial shoulder during operation. While three solid sealing elements 220 are shown in FIG. 2, the principles of the present disclosure are equally applicable to wellbore isolation devices that employ more or less than three solid sealing elements 220, without departing from the scope of the disclosure.

A mule shoe 222 may be positioned at or otherwise secured to the mandrel 206 at its lower or distal end. As will be appreciated, the lower most portion of the wellbore isolation device 200 need not be a mule shoe 222, but could be any type of section that serves to terminate the structure of the wellbore isolation device 200, or otherwise serves as a connector for connecting the wellbore isolation device 200 to other tools, such as a valve, tubing, or other downhole equipment.

In some embodiments, a spring 224 may be arranged within a chamber 226 defined in the mandrel 206 and otherwise positioned coaxial with and fluidly coupled to the central flow passage 210. At one end, the spring 224 biases a shoulder 228 defined by the chamber 226 and at its opposing end the spring 224 engages and otherwise supports the ball 208. The ball cage 204 may define a plurality of ports 230 (three shown) that allow the flow of fluids therethrough, thereby allowing fluids to flow through the length of the wellbore isolation device 200 via the central flow passage 210.

As the wellbore isolation device 200 is lowered into the wellbore 106, the spring 224 prevents the ball 208 from engaging the ball seat 212. As a result, fluids may pass through the wellbore isolation device 200; i.e., through the ports 230 and the central flow passage 210. The ball cage 204 retains the ball 208 such that it is not lost during translation into the wellbore 106 to its target location. Once the wellbore isolation device 200 reaches the target location, a setting tool (not shown) of a type known in the art can be used to move the wellbore isolation device 200 from its unset position (shown in FIG. 2) to a set position. The setting tool may operate via various mechanisms to anchor the wellbore isolation device 200 in the wellbore 106 including, but not limited to, hydraulic setting, mechanical setting, setting by swelling, setting by inflation, and the like.

After the wellbore isolation device 200 is set, fluid pressure may be increased within the wellbore 106 to overcome the spring force of the spring 224 as the ball 208 is forced against the spring 224. Overcoming the spring force may allow the ball 208 to engage and seal against ball seat 212, and thereby prevent fluid communication through the central flow passage 210. With the ball 208 sealingly engaged with the ball seat 212, the fluids within the wellbore 106 may be forced to other areas of the wellbore or surrounding formation for one or more wellbore completion and/or stimulation operations. Following the wellbore completion and/or stimulation operation, the fluid pressure may be decreased within the wellbore 106, thereby allowing the spring 224 to remove the ball 208 from engagement with the ball seat 212.

In setting the wellbore isolation device 200, the axial position of the slips 216*a,b* and/or the slip wedges 218*a,b* may be manipulated to plastically deform the solid sealing elements 220 and otherwise force the solid sealing elements 220 radially and into engagement with the inner walls of the casing 114. Forcing the solid sealing elements 220 radially into engagement with the inner walls of the casing 114 may result in the generation of high contact stress where the solid sealing elements 220 contact the casing 114 and the mandrel 206. As a result, the solid sealing elements 220 may provide a sealed engagement against the casing 114 and, in some embodiments, may also provide a fixed engagement with the casing 114, similar to the fixed engagement of one of the slips 216*a,b*. As used herein, the term "sealing," as used in "solid sealing elements" and elsewhere can refer to a fluid-tight seal as well as a "leaky" seal or, in other words, a seal where substantially all fluid migration is prevented across the sealed interface, but a small amount of fluid migration may be allowed. Unless specifically described as a fluid-tight seal, the sealing engagements described herein may be leaky seals.

As discussed in greater detail below, the solid sealing elements 220 may be made of various types of metals, metal alloys, and/or plastics. Suitable metal materials for the solid sealing elements 220 may exhibit a moderate to high strain-to-failure ratio since the solid sealing elements 220 are to be plastically deformed to provide a seal against the inner walls of the casing 114. In some cases, a plastic strain-to-failure of 12% will achieve the seal. In other embodiments, a 50% strain-to-failure will allow for more expansion of the seal. The solid sealing elements 220 may provide various advantages over traditional elastomeric or rubber sealing elements. For instance, the solid sealing elements 220 are able to provide a seal across a much shorter axial span within the casing 114 and therefore may be axially shorter than traditional elastomeric or rubber sealing elements. As compared to elastomeric or rubber sealing elements, which typically require the elastomer or rubber material to engage the casing 114 over a large axial span, the solid sealing elements 220 may have a single ring of contact stress that exhibits a shorter axial length. Shorter sealing elements, in turn, allow the wellbore isolation device 200 to be axially shorter and, therefore, reduce manufacturing costs.

Moreover, as mentioned above, the sealed engagement provided by the solid sealing elements 220 against the casing 114 may also serve as a slip for the wellbore isolation device 200, such as one of the slips 216*a,b*, which could further shorten the axial length of the wellbore isolation device 200. In some embodiments, for example, setting the solid sealing elements 220 against the casing 114 may result in indentation into the inner wall of the casing 114, which may increase the friction between the solid sealing elements 220 and the casing 114 such that the solid sealing elements 220 prevent the wellbore isolation device 200 from moving axially. In other embodiments, for example, setting the solid sealing elements 220 against the casing 114 may result in indentation into the solid sealing elements 220, which may also increase the friction. In such cases, one or both of the slips 216*a,b* may be omitted from the wellbore isolation device 200, which may instead rely on the solid sealing elements 220 to secure the wellbore isolation device 200 in position within the wellbore 106.

Another advantage of solid sealing elements 220 over traditional elastomeric or rubber sealing elements is that metal or plastic does not creep or flow as a rubbery or elastomeric element flows. As a result, the solid sealing elements 220 may be used and otherwise function properly in high temperature operations where traditional elastomeric or rubber sealing elements would otherwise creep and thereby fail to hold pressure. Lastly, metal and plastic are not susceptible to swabbing like rubbery elements, which allows for faster run-in speeds for the wellbore isolation device. More particularly, rubber or elastomeric sealing elements are susceptible to swabbing the inner walls of the casing 114 as they are run downhole, which could result in their early deployment before reaching the desired location in response to hydrodynamic forces. Solid sealing elements 220, on the other hand, are generally not susceptible to swabbing, which allows a well operator to run the wellbore isolation device 200 downhole at any desired speed.

Figure 3A:
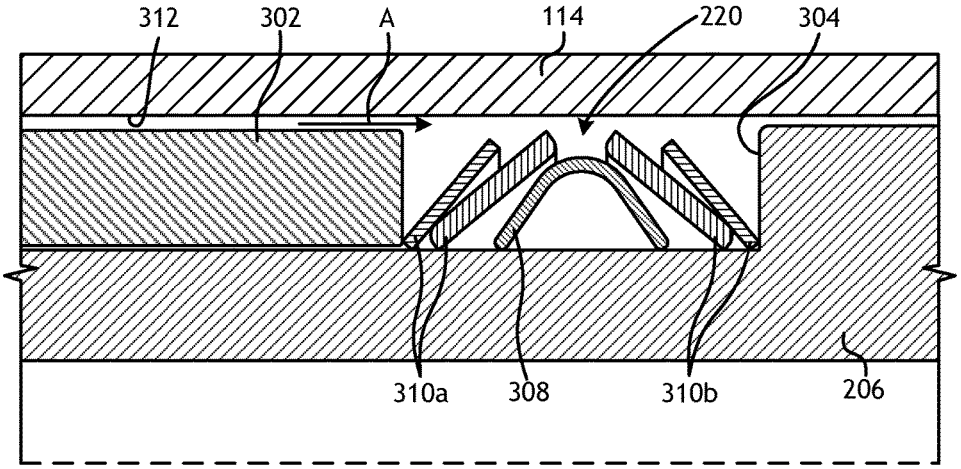
FIGS. 3A and 3B are cross-sectional side views of exemplary solid sealing elements during setting.
Figure 3B:
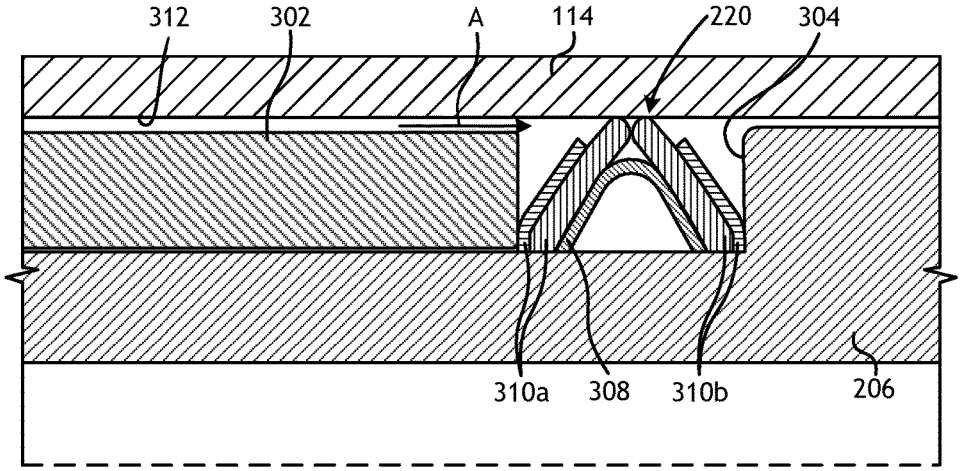

Referring to FIGS. 3A and 3B, illustrated are cross-sectional side views of exemplary solid sealing elements 220, according to one or more embodiments. More particularly, FIG. 3A depicts the solid sealing elements 220 prior to setting or in a "run-in" configuration, and FIG. 3B depicts the solid sealing elements 220 following setting. In the illustrated embodiment, the solid sealing elements 220 are depicted as being arranged between a slip wedge 302 and a radial shoulder 304. The slip wedge 302 may be similar to or the same as either of the upper or lower slip wedges 218*a,b*, and therefore configured to place an axial load on the solid sealing elements 220 to move them to the set position, as shown in FIG. 3B. In some embodiments, the radial shoulder 304 may comprise a portion of the mandrel 206, as illustrated. In other embodiments, however, the radial shoulder 304 may be an opposing slip wedge, such as the other of the upper or lower slip wedges 218*a,b*.

As illustrated, the solid sealing elements 220 may include a plurality of individual solid sealing elements. In other embodiments, however, the solid sealing elements 220 may comprise a single solid sealing element that is able to be plastically deformed to seal against an inner wall 312 of the casing 114. In the illustrated embodiment, the solid sealing elements 220 may include a center element 308, one or more downward facing elements 310*a*, and one or more upward facing elements 310*b*. The center element 308 may exhibit a substantially A-shaped cross-section but, as discussed below, may exhibit other cross-sectional shapes. The downward and upward facing elements 310*a,b* may each be frustoconical in shape and generally face toward the center element 308.

In some embodiments, the center element 308 may be a solid, triangular ring, without departing from the scope of the disclosure. In other embodiments, the A-shaped center element 308 may include a truss (not shown) that extends between the angled legs of the center element 308. Such a truss may provide structural support for the center element 308, thereby allowing the downward and upward facing elements 310*a,b* to slidingly engage the center element 308 in making contact with the inner wall 312 of the casing 114. In yet other embodiments, the center element 308 may be omitted altogether from the solid sealing elements 220, without departing from the scope of the disclosure.

During run-in, the solid sealing elements 220 are out of the flow path, and therefore do not engage the inner wall 312 of the casing 114. In operation, the slip wedge 302 may provide a compressive axial force on the solid sealing elements 220 in the direction A to move them to the set position. This may be done with the setting tool, as mentioned above, which may operate via various mechanisms such as, but not limited to, hydraulic actuation, mechanical actuation, electromechanical actuation, and the like. As the setting tool acts on the slip wedge 302 in the direction A, the solid sealing elements 220 are compressed against the radial shoulder 304 and plastically deformed into radial sealing engagement with the inner wall 312 of the casing 114, as shown in FIG. 3B.

In the illustrated embodiment, at least one of each of the downward and upward facing elements 310*a,b* is plastically deformed and otherwise forced into sealing engagement with the inner wall 312 of the casing 114. In the set position, there is high-stress contact between some or all of the solid sealing elements 220 and the casing 114 as well as between some or all of the solid sealing elements 220 and the mandrel 206. As a result, the wellbore 106 (FIGS. 1 and 2) may be fluidly sealed at that location. In some embodiments, the seal provided by the solid sealing elements 220 may be bi-directional; i.e., in either axial direction within the casing 114. In other embodiments, however, the seal provided by the solid sealing elements 220 may be uni-directional; i.e., in only one axial direction within the casing 114, without departing from the scope of the disclosure.

Figure 4A:
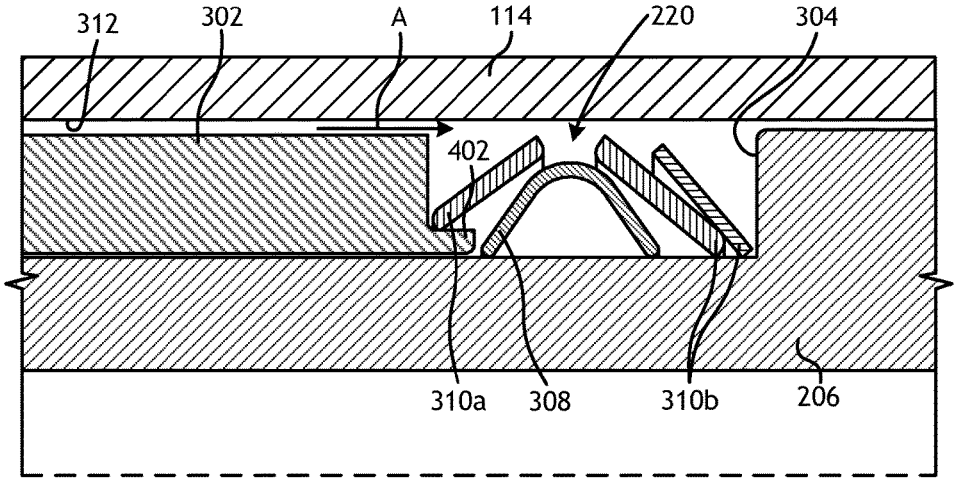
FIGS. 4A and 4B are cross-sectional side views of other exemplary solid sealing elements during setting.
Figure 4B:
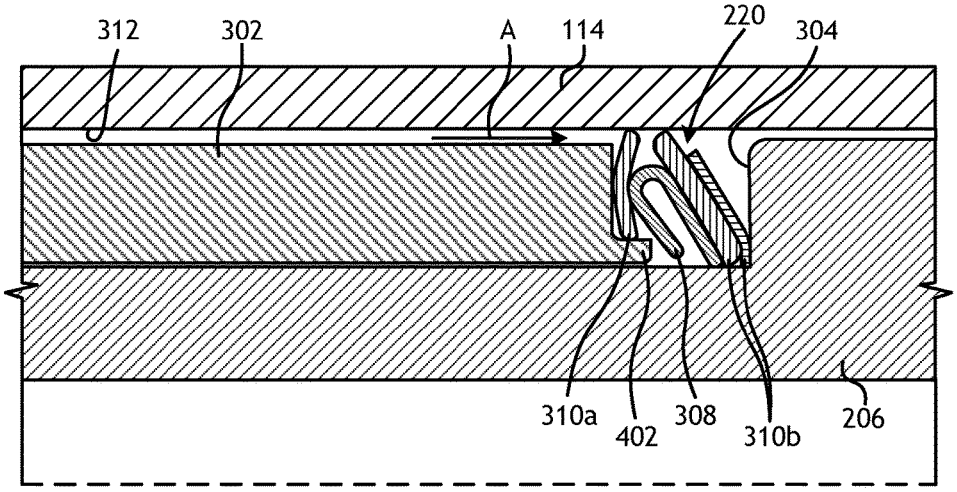

Referring to FIGS. 4A and 4B, illustrated are cross-sectional side views of other exemplary solid sealing elements 220, according to one or more embodiments. More particularly, FIG. 4A depicts the solid sealing elements 220 in the run-in configuration, and FIG. 4B depicts the solid sealing elements 220 following setting within the casing 114. Like numerals from FIGS. 3A-3B used in FIGS. 4A-4B indicate like elements not described again. As illustrated, the solid sealing elements 220 may include the center element 308, one or more downward facing elements 310*a*, and one or more upward facing elements 310*b*.

Unlike the embodiment of FIGS. 3A-3B, however, the downward and upward facing elements 310*a,b* of FIGS. 4A-4B are asymmetrical in that there is only one downward facing element 310*a*. This may prove advantageous in applications where the wellbore isolation device 200 (FIG. 2) is needed to seal in only one direction (uni-axially) within the casing 114. More particularly, the downward facing element 310*a* may be included in the solid sealing elements 220 to help set at least one of the upward facing elements 310*b*, such as the larger (thicker) of the upward facing elements 310*b*. The larger (thicker) of the upward facing elements 310*b* may be used to provide a seal in one direction within the casing 114. Moreover, the one downward facing element 310*a* may be seated on a ledge 402 defined or otherwise provided on the slip wedge 302. The ledge 402 may prove advantageous reducing friction between the downward facing element 310*a* and the mandrel 206.

The slip wedge 302 may provide a compressive axial force on the solid sealing elements 220 in the direction A. As the slip wedge 302 moves in the direction A, the solid sealing elements 220 are compressed against the radial shoulder 304 and plastically deformed into radial sealing engagement with the inner wall 312 of the casing 114. In the illustrated embodiment, at least one of each of the downward and upward facing elements 310*a,b* is plastically deformed and otherwise forced into sealing engagement with the inner wall 312 of the casing 114. In the set position, there is high-stress contact between some or all of the solid sealing elements 220 and the casing 114 as well as between some or all of the solid sealing elements 220 and the mandrel 206.

Figure 5A:
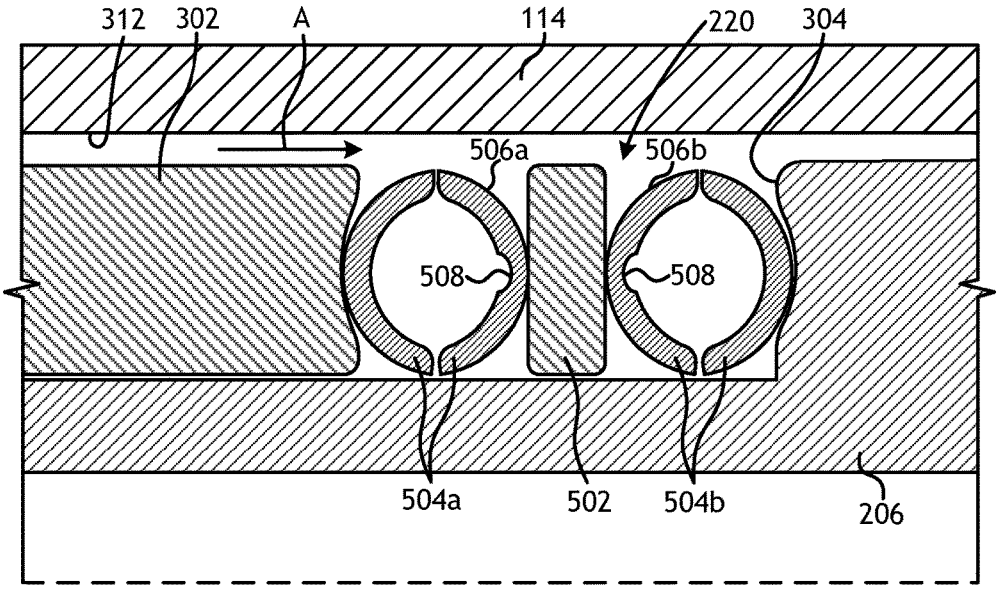
FIGS. 5A and 5B are cross-sectional side views of other exemplary solid sealing elements during setting.
Figure 5B:
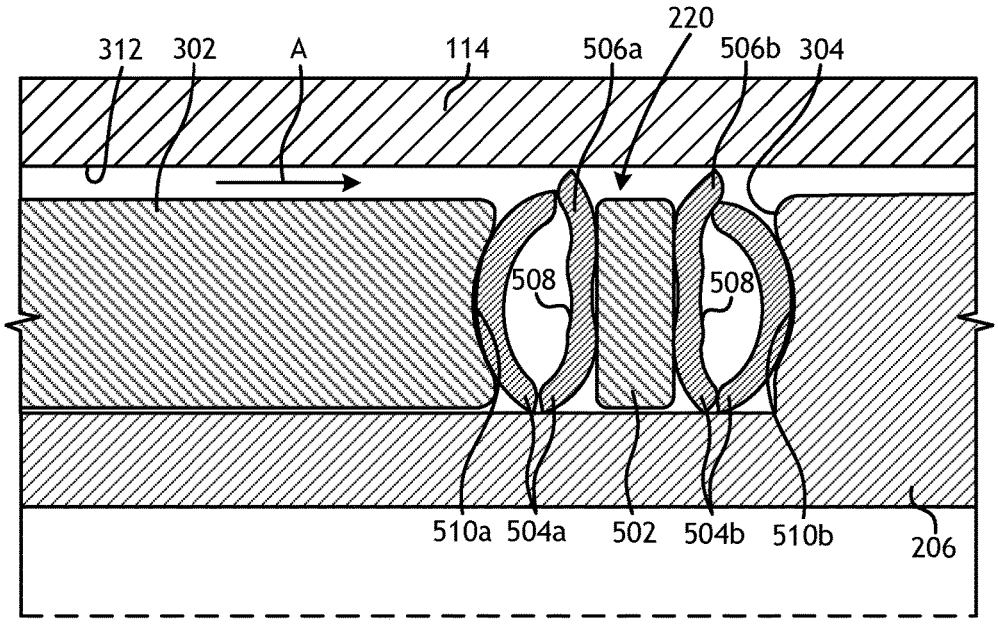

Referring to FIGS. 5A and 5B, illustrated are cross-sectional side views of other exemplary solid sealing elements 220, according to one or more embodiments. FIG. 5A depicts the solid sealing elements 220 in the run-in configuration, and FIG. 5B depicts the solid sealing elements 220 following setting within the casing 114. Like numerals from FIGS. 3A-3B used in FIGS. 5A-5B indicate like elements not described again. In the illustrated embodiment, the solid sealing elements 220 may include a center element 502, one or more upper elements 504*a*, and one or more lower elements 504*b*. In some embodiments, the center element 502 may be a solid ring that exhibits a rectangular cross-section, as illustrated. In other embodiments, the center element 502 may exhibit other cross-sectional shapes, such as square, triangular, arcuate, or oval, without separating from the scope of the disclosure.

As illustrated, the upper and lower elements 504*a,b* may each exhibit a substantially C-shaped cross-section and may include an upper inner element 506*a* and a lower inner element 506*b*. In some embodiments, the upper and lower inner elements 506*a,b* may each exhibit a varying width. More particularly, the upper and lower inner elements 506*a,b* may each provide or otherwise define a reduced thickness section 508. In the illustrated embodiment, the reduced thickness section 508 of each of the upper and lower inner elements 506*a,b* are axially adjacent the center element 502. As will be appreciated, the reduced thickness section 508 allows the upper and lower inner elements 506*a,b* to collapse and otherwise plastically deform before the adjacent upper and lower elements 504*a,b*.

In some embodiments, the axial end 510*a* of the slip wedge 302 and the axial end 510*b* of the radial shoulder 304 may be arcuate and otherwise define a curved surface. The curved surfaces of the axial ends 510*a,b* may prove advantageous in cradling the adjacent upper and lower elements 504*a,b*, respectively, and thereby help maintain the solid sealing elements 220 within the mandrel 206 area while being compressed. The curved surfaces of the axial ends 510*a,b* may further prove advantageous in keeping the axially outermost upper and lower elements 504*a,b* from buckling prematurely, and otherwise from plastically deforming prior to the upper and lower inner elements 506*a,b*.

Again, the slip wedge 302 may provide a compressive axial force on the solid sealing elements 220 in the direction A. As the slip wedge 302 moves in the direction A, the solid sealing elements 220 are placed in axial compression between the slip wedge 302 and the radial shoulder 304, thereby resulting in one or all of the solid sealing elements 220 plastically deforming into sealing engagement with the inner wall 312 of the casing 114. In the illustrated embodiment, in consequence of the reduced thickness sections 508, the upper and lower inner elements 506*a,b* may buckle first and plastically deform into radial sealing engagement with the inner wall 312 of the casing 114. In the set position, there is high-stress contact between some or all of the solid sealing elements 220 and the casing 114 as well as between some or all of the solid sealing elements 220 and the mandrel 206.

Figure 6A:
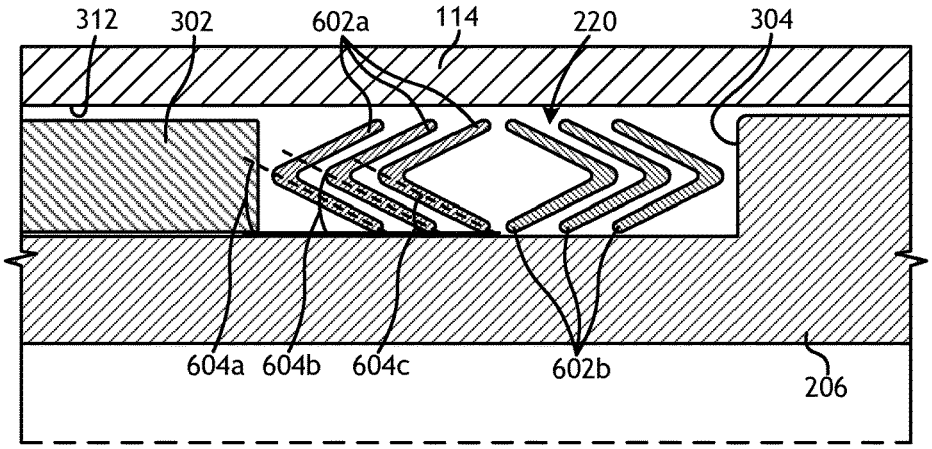
FIGS. 6A, 6B, and 6C are cross-sectional side views of other exemplary solid sealing elements.
Figure 6B:
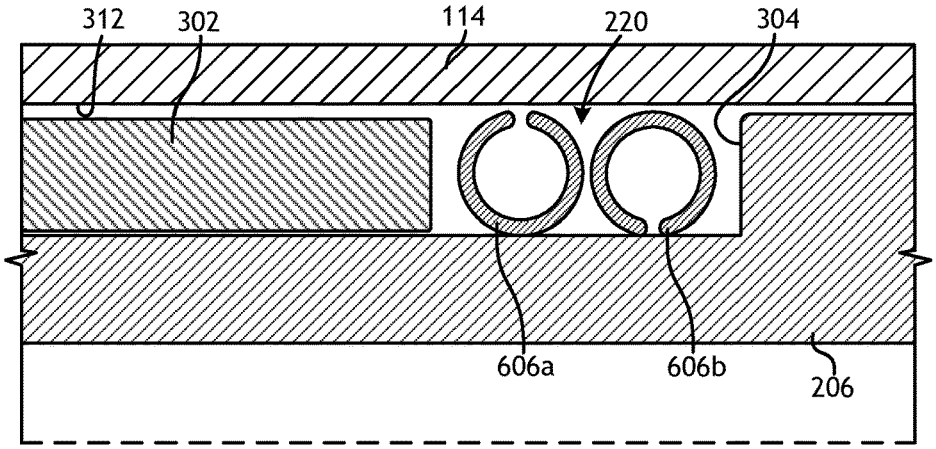
Figure 6C:
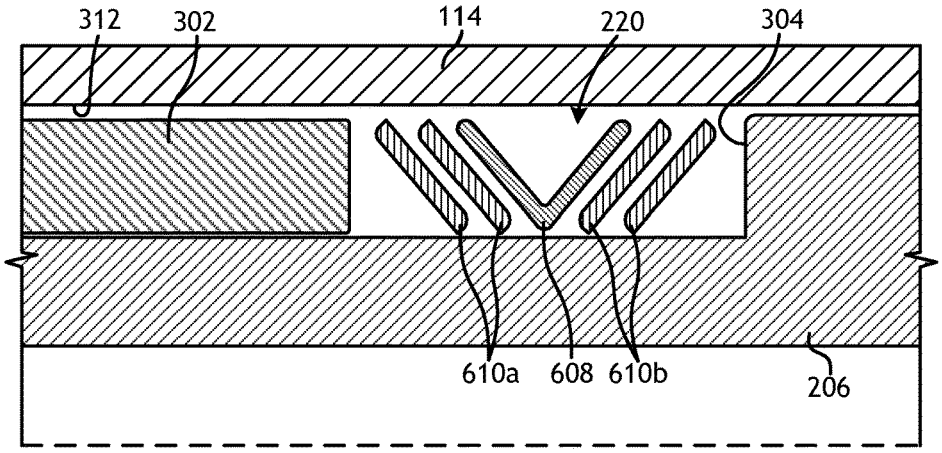

Other cross-sectional shapes for the solid sealing elements 220 are also possible, without departing from the scope of the disclosure. For example, FIGS. 6A, 6B, and 6C depict cross-sectional side views of other exemplary solid sealing elements 220, according to one or more embodiments. Like numerals from FIGS. 3A-3B used in FIGS. 6A-6C indicate like elements not described again. In FIG. 6A, the solid sealing elements 220 exhibit a substantially K-shaped cross-section, the solid sealing elements 220 exhibit a substantially O-shaped cross-section in FIG. 6B, and the solid sealing elements 220 exhibit a substantially V-shaped cross-section in FIG. 6C. Without departing from the scope of the disclosure, the cross-section of any of the elements may be any shape that is created by revolving a plane geometric figure around the centerline of the tool, especially where the plane geometric figure has an open geometry. An open geometry is a geometric figure that can be drawn with a single continuous line.

More particularly, in FIG. 6A, the solid sealing elements 220 may include one or more downward facing elements 602*a*, and one or more upward facing elements 602*b*, where the upward facing elements 602*a* are nested within one another, the downward facing elements 602*b* are nested within one another, and the upper and downward facing elements 602*a,b* generally face each other. As illustrated, the downward facing elements 602*a* may exhibit angles 604*a*, 604*b*, and 604*c* with respect to the mandrel 206, where angle 604*a* is greater than angle 604*b*, and angle 604*b* is greater than angle 604*c*. As will be appreciated, the graded-nature of the angles 604*a-c* may allow the downward facing elements 602*a* to more easily seal against the inner wall 312 of the casing 114. More particularly, the outer diameter of each downward facing element 602*a* may be substantially the same and, therefore, the downward facing element 602*a* exhibiting the third or lower angle 604*c* may have more length, which, when flattened, will result in more change in its outer diameter as compared with the remaining downward facing elements 602*a*.

Also, the gradation in the angles 604*a-c* allows the downward facing elements 602*a* to support each other in their nested relationship when deployed. Thus, the change in outer diameter between the run-in configuration and the set configuration may be spread over all of the downward facing elements 602*a*. This reduces the bending load on each individual downward facing element 602*a* when a pressure differential is applied, and thereby essentially reducing the extrusion gap for each downward facing element 602*a*.

While not depicted, similar angles may be exhibited by the upward facing elements 602*b*, but in the opposite axial direction. As a result, axial compression of the downward and upward facing elements 602*a,b* using the slip wedge 302 may result in the plastic deformation of the downward and upward facing elements 602*a,b* into sealing engagement with the inner wall 312 of the casing 114.

In FIG. 6B, the solid sealing elements 220 may comprise one or more discontinuous rings 606, shown as a first ring 606*a* and a second ring 606*b*. When the rings 606*a,b* are axially compressed between the slip wedge 302 and the radial shoulder 304, they may be configured to collapse and otherwise plastically deform into radial sealing engagement with the inner wall 312 of the casing 114.

In FIG. 6C, the solid sealing elements 220 may comprise a center element 608, one or more upward facing elements 610*a*, and one or more downward facing elements 610*b*. In some embodiments, the center element 608 may exhibit a substantially V-shaped cross-section and the upward and downward facing elements 610*a,b* may face axially away from the center element 608. The upward and downward facing elements 610*a,b* may each be frustoconical in shape. In some embodiments, the center element 608 may be a solid, triangular ring, without departing from the scope of the disclosure. In other embodiments, the A-shaped center element 608 may include a truss (not shown) that extends between the angled legs of the center element 608. In such embodiments, the truss may provide structural support for the center element 608, thereby allowing the upward and downward facing elements 610*a,b* to slidingly engage the center element 608 to make radial contact with the inner wall 312 of the casing 114. In yet other embodiments, the center element 608 may be omitted altogether from the solid sealing elements 220, without departing from the scope of the disclosure.

The seal provided by the solid sealing elements 220 in FIGS. 6A-6C may be bi-directional; i.e., in either axial direction within the casing 114. In other embodiments, however, the seal provided by the solid sealing elements 220 of FIGS. 6A-6C may be uni-directional; i.e., in only one axial direction within the casing 114, without departing from the scope of the disclosure. In any case, the solid sealing elements 220 may be plastically deformable and thereby able to create a high-contact pressure between the solid sealing elements 220 and the inner wall 312 of the casing 114 and between the solid sealing elements 220 and the mandrel 206.

The solid sealing elements 220 described herein may be configured to assume and resist multiple pressure cycles within the casing string 114. More particularly, during a typical wellbore operation that may require the wellbore 106 (FIGS. 1 and 2) to be sealed using the wellbore isolation device 116, 200 (FIGS. 1 and 2), pressures within the casing 114 may be applied, removed, and reapplied multiple times before the wellbore operation is complete. The solid sealing elements 220 may be configured to handle a predetermined number of pressure cycles and still maintain its seal.

As indicated above, the solid sealing elements 220 may be made of metals, metal alloys, and/or plastics. In some embodiments, the solid sealing elements 220 may be non-degradable and otherwise made of a non-degradable material. Suitable non-degrading metals include any metal that exhibits a high strain-to-failure ratio. Non-degradable metals suitable for the solid sealing elements 220 include, but are not limited to, stainless steel (e.g., 316), annealed INCONEL®, carbon steels, steel-nickel alloys, titanium, titanium alloys, magnesium, magnesium alloys, and any combination thereof. Suitable non-degradable plastics include, but are not limited to, polytetrafluoroethylene (PTFE), polyetherimide (PEI or ULTEM®), polyphenylene sulfide (PPS), polyether-ether ketone (PEEK), fiber reinforced epoxies, and any combination thereof.

In some applications, the wellbore isolation device 200 of FIG. 2 may be a dissolving or degradable-type wellbore isolation device. In such embodiments, having the solid sealing elements 220 made of a non-degradable material may prove advantageous in allowing the various components of the wellbore isolation device 200 to degrade or dissolve while the solid sealing elements 220 remain in one axial location within the wellbore 106, which prevents production of any pieces of the solid sealing elements 220.

In other embodiments, the solid sealing elements 220 may be degradable and otherwise made of a degradable or dissolvable material. Degradable metal solid sealing elements 220 may provide various advantages over traditional degradable elastomeric or rubber sealing elements. For instance, metals typically degrade and/or dissolve more cleanly than elastomeric or rubber sealing elements, which tend to shed pieces of rubber/elastomer while degrading in a downhole environment.

As used herein, the term "degradable" and all of its grammatical variants (e.g., "degrade," "degradation," "degrading," "dissolve," dissolving," and the like) refers to the dissolution or chemical conversion of solid materials such that reduced-mass solid end products by at least one of solubilization, hydrolytic degradation, biologically formed entities (e.g., bacteria or enzymes), chemical reactions (including electrochemical and galvanic reactions), thermal reactions, or reactions induced by radiation. In complete degradation, no solid end products result. In some instances, the degradation of the material may be sufficient for the mechanical properties of the material to be reduced to a point that the material no longer maintains its integrity and, in essence, falls apart or sloughs off to its surroundings. The conditions for degradation are generally wellbore conditions where an external stimulus may be used to initiate or effect the rate of degradation. For example, the pH of the fluid that interacts with the material may be changed by introduction of an acid or a base. The term "wellbore environment" includes both naturally occurring wellbore environments and materials or fluids introduced into the wellbore. As discussed in detail below, degradation of the degradable materials identified herein may be accelerated, rapid, or normal, degrading anywhere from about 30 minutes to about 40 days from first contact with the appropriate wellbore environment or stimulant.

In some embodiments, suitable degradable materials for the solid sealing elements 220 may be metals that galvanically-react or corrode in wellbore fluid or in a wellbore environment. A galvanically-corrodible metal may be configured to degrade via an electrochemical process in which the galvanically-corrodible metal corrodes in the presence of an electrolyte (e.g., brine or other salt-containing fluids present within the wellbore 106). Suitable galvanically-corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. As the foregoing materials can be alloyed together or alloyed with other materials to control their rates of corrosion. Suitable galvanically-corrodible metals also include micro-galvanic metals or materials, such as nano-structured matrix galvanic materials. One example of a nano-structured matrix micro-galvanic material is a magnesium alloy with iron-coated inclusions.

Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible Mg alloys could also be solution structured with other elements such as zinc, aluminum, nickel, iron, calcium, carbon, tin, silver, palladium, copper, titanium, rare earth elements, etc. Micro-galvanically-corrodible aluminum alloys could be in solution with elements such as nickel, iron, calcium, carbon, tin, silver, copper, titanium, gallium, etc.

In other embodiments, suitable degradable metals for the solid sealing elements 220 may be metals that dissolve in the wellbore fluid or the wellbore environment. For example, metal alloys with high composition in aluminum, magnesium, zinc, silver, or copper may be prone to dissolution in a wellbore environment. The degradable material may comprise dissimilar metals that generate a galvanic coupling that either accelerates or decelerates the degradation or dissolution rate of the solid sealing elements 220. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable material. In such embodiments, the degradation rate of the degradable material may be decelerated until the sacrificial anode is dissolved or otherwise corroded away. In at least one embodiment, the solid sealing elements 220 may comprise an aluminum-gallium alloy configured to dissolve in the wellbore environment.

Suitable degradable plastics for the solid sealing elements 220 may include degradable polymers, such as polyglycolic acid (PGA) and polylactic acid (PLA), and thiol-based plastics. With respect to degradable polymers, a polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(ϵ-caprolactones), poly (hydroxybutyrates), poly(anhydrides), aliphatic or aromatic polycarbonates, poly(orthoesters), poly(amino acids), poly (ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. Of these degradable polymers, as mentioned above, PGA and PLA may be preferred. Polyglycolic acid and polylactic acid tend to degrade by hydrolysis as the temperature increases.

Polyanhydrides are another type of particularly suitable degradable polymer useful in the embodiments of the present disclosure. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly(maleic anhydride) and poly(benzoic anhydride).

In some embodiments, the solid sealing elements 220 may be made of two or more materials, such as a combination of a metal and a plastic. In other embodiments, the solid sealing elements 220 may be made of a material that forms a metal-to-metal matrix or is bi-metallic. Suitable materials in such embodiments include, but are not limited to a boron-reinforced metal. A bi-metallic combination may also be created by having the center, downward, and upward elements constructed from different materials. For example, the central element could be composed of a degradable magnesium alloy and the side elements may be composed from a degradable tin alloy. The different galvanic potentials would control the rate of degradation and the location where the degradation would first occur. In other embodiments, the material of the solid sealing elements 220 may be a composite material and otherwise include a reinforcing material to provide additional stiffness and sealing pressure.

In some embodiments, one or more of the solid sealing elements 220 may be at least partially encapsulated in a second material or "sheath" disposed on all or a portion of one or more of the solid sealing elements 220. The sheath may be configured to help prolong degradation of the given component of the wellbore isolation device 200, but may also serve to protect the solid sealing elements 220 from abrasion within the wellbore 106 (FIGS. 1 and 2). The sheath may be permeable, frangible, or comprise a material that is at least partially removable at a desired rate within the wellbore environment. In either scenario, the sheath may be designed such that it does not interfere with the ability of the solid sealing elements 220 to form a fluid seal in the wellbore 106.

The sheath may comprise any material capable of use in a downhole environment. In at least one embodiment, the sheath may comprise rubber or an elastomer, which may prove advantageous in helping the solid sealing elements 220 make a more fluid tight seal against the casing 114. Other suitable materials for the sheath include, but are not limited to, a TEFLON® coating, a wax, an elastomer, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, an electrochemical coating, and any combination thereof. Suitable examples of electrochemical coatings include, but are not limited to, electroplating, electroless electroplating, anodic oxidation, anodic plasma-chemical, chemical vapor deposition, and combinations thereof.

In some embodiments, a material or substance may be positioned between adjacent sealing elements of the solid sealing elements 220. In at least one embodiment, for instance, a thin piece of rubber or plastic may be sandwiched between adjacent sealing elements of the solid sealing elements 220 to control friction. The rubber or plastic material may also prove advantageous in helping the solid sealing elements 220 make a more fluid tight seal against the casing 114. Such an embodiment may prove useful where the solid sealing elements 220 are made of a degradable material. In other embodiments, some of the sealing elements could be made from different types of materials. For example, the center element could be a dissolvable metal, such as an aluminum alloy, and the outer elements could be a dissolvable plastic, such as PLA. The degradation of the dissolvable plastic would lower the pH of the surrounding fluid and that would accelerate the degradation of the dissolvable metal.

In some embodiments, various sealing elements of the solid sealing elements 220 may be made of different materials. For example, the center element 308 in FIGS. 3A-3B and 4A-4B or the center element 608 in FIGS. 6A-6B may comprise a material with a higher elastic response than the remaining solid sealing elements 220, which may comprise a softer material than the center elements 308, 608. As will be appreciated, this may enhance the pressure holding capabilities of the solid sealing elements 220. In one or more embodiments, the solid sealing elements 220 may be designed with a predetermined yield strength so that they perform in a predetermined manner under compression. For example, the downward and upward facing elements 310*a,b* of FIGS. 3A-3B and 4A-4C may exhibit a lower yield strength as compared to the center element 308 so that they may be forced radially against the casing 114 and are more likely to cause indentation in to the surface of the casing 114. In such embodiment, the center element 308 may exhibit a higher yield strength so that does not plastically deform before the downward and upward facing elements 310*a,b*.

Referring again to FIG. 2, with continued reference to the other figures discussed herein, the wellbore isolation device 200 may be set within the wellbore 106 to undertake one or more completion or stimulation operations. Following the completion and/or stimulation operations, the wellbore isolation device 200 may be removed from the wellbore 106 in order to allow production operations to effectively occur without being hindered by the emplacement of the wellbore isolation device 200. Several components of the wellbore isolation device 200 may be made of or otherwise comprise a degradable material configured to degrade or dissolve within the wellbore 106 environment. Exemplary components of the wellbore isolation device 200 that may be made of or otherwise comprise a degradable material include, but are not limited to, the mandrel 206, the ball 208, the upper and lower slips 216*a,b*, the upper and lower slip wedges 218*a,b*, and the mule shoe 222. The foregoing structural elements or components of the wellbore isolation device 200 are collectively referred to herein as "the components" in the following discussion.

In some embodiments, two or more of the components may exhibit the same or substantially the same degradation rate and, therefore, may be configured to degrade at about the same rate. In other embodiments, one or more of the components may be configured to degrade or dissolve at a degradation rate that is different from the other components. In at least one embodiment, one or more of the components that anchor the wellbore isolation device 200 in the wellbore 106 may exhibit a degradation rate that is lower (i.e., slower) than the degradation rate of other components to avoid having portions of the wellbore isolation device 200 prematurely detach from the wellbore 106 and flow uphole. Consequently, in at least one embodiment, the upper and lower slips 216*a,b*, the upper and lower slip wedges 218*a,b*, and/or the solid sealing elements 220, which cooperatively anchor the wellbore isolation device 200 in the wellbore 106, may exhibit a degradation rate that is lower (i.e., slower) than the mandrel 206, the mule shoe 222, or the ball 208. In such embodiments, the mandrel 206, the mule shoe 222, and the ball 208 will degrade or otherwise dissolve prior to the degradation of the upper and lower slips 216*a,b*, the upper and lower slip wedges 218*a,b*, and the solid sealing elements 220.

Suitable degradable materials that may be used in the components include borate glass, polyglycolic acid (PGA), polylactic acid (PLA), a degradable rubber, degradable polymers, galvanically-corrodible metals, dissolvable metals, dehydrated salts, and any combination thereof. The degradable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the degradable material of aqueous fluids or hydrocarbon fluids present within the wellbore environment such that the mechanical properties of the degradable material degrade or fail. Exemplary hydrocarbon fluids that may swell and degrade the degradable material include, but are not limited to, crude oil, a fractional distillate of crude oil a saturated hydrocarbon, an unsaturated hydrocarbon, a branched hydrocarbon, a cyclic hydrocarbon, and any combination thereof. Exemplary aqueous fluids that may swell to degrade the degradable material include, but are not limited to, fresh water, saltwater (e.g., water containing one or more salts dissolved therein), brine (e.g., saturated salt water), seawater, acids, bases, or combinations thereof. In degradation by swelling, the degradable material continues to absorb the aqueous and/or hydrocarbon fluid until its mechanical properties are no longer capable of maintaining the integrity of the degradable material and it at least partially falls apart. In some embodiments, the degradable material may be designed to only partially degrade by swelling in order to ensure that the mechanical properties of the component formed from the degradable material is sufficiently capable of lasting for the duration of the specific operation in which it is used.

Degradation by dissolving involves a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid.

Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment.

Thermal degradation of the degradable material involves a chemical decomposition due to heat, such as the heat present in a wellbore environment. Thermal degradation of some degradable materials mentioned or contemplated herein may occur at wellbore environment temperatures that exceed about 93° C. (or about 200° F.).

With respect to degradable polymers used as a degradable material, any of the degradable polymers discussed above with respect to the solid sealing elements 220 are suitable. With respect to galvanically-corrodible metals used as a degradable material, the galvanically-corrodible metals discussed above are suitable, including any micro-galvanic metals or materials and galvanic coupling metals.

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the degradable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly(m-methylstyrene), poly(p-methylstyrene), poly(2,4-dimethylstyrene), poly(2,5-dimethylstyrene), poly(p-tert-butylstyrene), poly(p-chlorostyrene), poly(α-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the degradable material forming the component may be any amount that confers a desirable elasticity without affecting the desired amount of degradation.

In some embodiments, the degradable material may release an accelerant during degradation that accelerates the degradation of the component itself or an adjacent component of the wellbore isolation device 200. In at least one embodiment, for instance, one or more of the components may be configured to release the accelerant to initiate and accelerate degradation of its own degradable material. In other cases, the accelerant may be embedded in the degradable material of one or more of the components and gradually released as the corresponding component degrades. In some embodiments, for example, the accelerant is a natural component released upon degradation of the degradable material, such as an acid (e.g., release of an acid upon degradation of the degradable material formed from a polylactide). Similarly, degradation of the degradable material may release a base that would aid in degrading the component, such as, for example, if the degradable material were composed of a galvanically-corrodible or reacting metal or material. As will be appreciated, the accelerant may comprise any form, including a solid form or a liquid form.

Suitable accelerants may include, but are not limited to, a chemical, a crosslinker, sulfur, a sulfur-releasing agent, a peroxide, a peroxide releasing agent, a catalyst, an acid releasing agent, a base releasing agent, and any combination thereof. In some embodiments, the accelerant may cause the degradable material to become brittle to aid in degradation. Specific accelerants may include, but are not limited to, a polylactide, a polyglycolide, an ester, a cyclic ester, a diester, an anhydride, a lactone, an amide, an anhydride, an alkali metal alkoxide, a carbonate, a bicarbonate, an alcohol, an alkali metal hydroxide, ammonium hydroxide, sodium hydroxide, potassium hydroxide, an amine, an alkanol amine, an inorganic acid or precursor thereof (e.g., hydrochloric acid, hydrofluoric acid, ammonium bifluoride, and the like), an organic acid or precursor thereof (e.g., formic acid, acetic acid, lactic acid, glycolic acid, aminopolycarboxylic acid, polyaminopolycarboxylic acid, and the like), and any combination thereof.

In some embodiments, blends of certain degradable materials may also be suitable as the degradable material for the components of the wellbore isolation device 200. One example of a suitable blend of degradable materials is a mixture of PLA and sodium borate where the mixing of an acid and base could result in a neutral solution where this is desirable. Another example may include a blend of PLA and boric oxide. The choice of blended degradable materials also can depend, at least in part, on the conditions of the well, e.g., wellbore temperature. For instance, lactides have been found to be suitable for lower temperature wells, including those within the range of 60° F. to 150° F., and PLAs have been found to be suitable for well bore temperatures above this range. Also, PLA may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, the degradable material may be at least partially encapsulated in a second material or "sheath" disposed on all or a portion of a given component of the wellbore isolation device 200. The sheath may be similar to the sheath discussed above with respect to the solid sealing elements 220, and therefore will not be described again.

In some embodiments, all or a portion of the outer surface of a given component of the wellbore isolation device 200 may be treated to impede degradation. For example, the outer surface of a given component may undergo a treatment that aids in preventing the degradable material (e.g., a galvanically-corrodible metal) from galvanically-corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of a given component. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of a given component of the wellbore isolation device 200 may be treated or coated with a substance configured to enhance degradation of the degradable material. For example, such a treatment or coating may be configured to remove a protective coating or treatment or otherwise accelerate the degradation of the degradable material of the given component.

While the foregoing description and embodiments are directed primarily to a degradable or disappearing frac plug, those skilled in the art will readily recognize that the principles of the present disclosure could equally be applied to any traditional wellbore isolation device including, but not limited to, a bridge plug, a wellbore packer, a wiper plug, a cement plug, or any combination thereof. Especially for a high-temperature packer that needs to primarily hold pressure in one direction, the solid sealing elements 220 may prove useful in providing a long-term and high-temperature seal within the wellbore 106 (FIGS. 1 and 2). Moreover, while the foregoing description and embodiments are directed primarily to setting wellbore isolation devices within a casing 114 (FIGS. 1 and 2), the principles of the present disclosure are equally applicable to open hole applications.

Embodiments disclosed herein include:

A. A wellbore isolation device that includes a mandrel, one or more solid sealing elements disposed about the mandrel and plastically deformable to seal against an inner wall of a casing or an inner wall of a wellbore, a slip wedge disposed about the mandrel on a first axial end of the one or more solid sealing elements, and a radial shoulder positioned on the mandrel at a second axial end of the one or more sealing elements, wherein at least the slip wedge applies a compressive force on the one or more solid sealing elements and thereby plastically deforms the one or more solid sealing elements into sealing engagement with the inner wall of the casing or the wellbore.

B. A method that includes introducing a wellbore isolation device into a wellbore, the wellbore isolation device including a mandrel, one or more solid sealing elements disposed about the mandrel, a slip wedge disposed about the mandrel on a first axial end of the one or more solid sealing elements, and a radial shoulder positioned on the mandrel at a second axial end of the one or more sealing elements, providing a compressive force on the one or more solid sealing elements with at least the slip wedge, plastically deforming the one or more solid sealing elements into sealing engagement with an inner wall the wellbore or an inner wall of a casing positioned within the wellbore, and sealing the wellbore with the one or more solid sealing elements.

Each of embodiments A and B may have one or more of the following additional elements in any combination: Element 1: wherein the wellbore isolation device is a device selected from the group consisting of a frac plug, a bridge plug, a wellbore packer, an open hole packer, a wiper plug, a cement plug, and any combination thereof. Element 2: wherein the slip wedge is a first slip wedge and the radial shoulder is a second slip wedge disposed about the mandrel on the second axial end of the one or more solid sealing elements. Element 3: wherein the radial shoulder comprises a portion of the mandrel. Element 4: wherein the one or more solid sealing elements comprise a center element, one or more downward facing elements, and one or more upward facing elements, wherein the one or more downward facing elements and the one or more upward facing elements are frustoconical in shape. Element 5: wherein the center element exhibits an A-shaped cross-section or a V-shaped cross-section. Element 6: wherein the one or more solid sealing elements comprise at least one sealing element that exhibits a reduced thickness section. Element 7: wherein the one or more solid sealing elements exhibit a cross-sectional shape selected from the group consisting of A-shaped elements, V-shaped elements, C-shaped elements, O-shaped elements, K-shaped elements, and any combination thereof. Element 8: wherein the one or more solid sealing elements provide a bi-directional seal against the inner wall of the casing or the wellbore. Element 9: wherein the one or more solid sealing elements provide a uni-directional seal against the inner wall of the casing or the wellbore. Element 10: wherein the one or more solid sealing elements are made of a non-degradable material selected from the group consisting of a metal, a metal alloy, a plastic, and any combination thereof. Element 11: wherein the one or more solid sealing elements are made of a degradable material selected from the group consisting of a degradable polymer, a galvanically-corrodible metal, a blend of dissimilar metals that generates a galvanic coupling, and any combination thereof. Element 12: wherein the mandrel is made of a degradable material selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof. Element 13: further comprising a sheath disposed on all or a portion of at least one of the one or more solid sealing elements, the sheath being a material selected from the group consisting of a TEFLON® coating, a wax, an elastomer, a drying oil, a polyurethane, an epoxy, a cross-linked partially hydrolyzed polyacrylic, a silicate material, a glass, an inorganic durable material, a polymer, polylactic acid, polyvinyl alcohol, polyvinylidene chloride, a hydrophobic coating, paint, an electrochemical coating and any combination thereof. Element 14: further comprising a thin piece of rubber or plastic positioned between adjacent sealing elements of the one or more solid sealing elements.

Element 15: wherein the wellbore isolation device is a device selected from the group consisting of a frac plug, a bridge plug, a wellbore packer, an open hole packer, a wiper plug, a cement plug, and any combination thereof. Element 16: wherein sealing the wellbore with the one or more solid sealing elements comprises providing a bi-directional seal within the wellbore. Element 17: wherein sealing the wellbore with the one or more solid sealing elements comprises providing a uni-directional seal within the wellbore. Element 18: wherein the one or more solid sealing elements are made of a non-degradable material selected from the group consisting of a metal, a metal alloy, a plastic, and any combination thereof. Element 19: wherein the one or more solid sealing elements are made of a degradable material, the method further comprising performing at least one downhole operation, and degrading the degradable material of the one or more solid elements, the degradable material being selected from the group consisting of a degradable polymer, a galvanically-corrodible metal, a blend of dissimilar metals that generates a galvanic coupling, and any combination thereof. Element 20: wherein the mandrel is made of a degradable material, the method further comprising degrading the degradable material of the one or more solid sealing elements at a first degradation rate, and degrading the degradable material of the mandrel at a second degradation rate that is faster than the first degradation rate, the degradable material of the mandrel being selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof.

By way of non-limiting example, exemplary combinations applicable to A and B include: Element 8 with Element 10; Element 9 with Element 10; Element 11 with Element 12; and Element 19 with Element 20.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A wellbore isolation device, comprising: a mandrel; one or more solid sealing elements disposed about the mandrel and plastically deformable to seal against an inner wall of a casing or an inner wall of a wellbore, wherein the one or more solid sealing elements are made of a solution-structured galvanic material of magnesium alloy that includes at least one of zinc, aluminum, nickel, copper, and rare earth elements; a slip wedge disposed about the mandrel on a first axial end of the one or more solid sealing elements; and a radial shoulder positioned on the mandrel at a second axial end of the one or more sealing elements, wherein at least the slip wedge applies a compressive force on the one or more solid sealing elements and thereby plastically deforms the one or more solid sealing elements into sealing engagement with the inner wall of the casing or the wellbore.

2. The wellbore isolation device of claim 1, wherein the wellbore isolation device is a device selected from the group consisting of a frac plug, a bridge plug, a wellbore packer, an open hole packer, a wiper plug, a cement plug, and any combination thereof.

3. The wellbore isolation device of claim 1, wherein the slip wedge is a first slip wedge and the radial shoulder is a second slip wedge disposed about the mandrel on the second axial end of the one or more solid sealing elements.

4. The wellbore isolation device of claim 1, wherein the radial shoulder comprises a portion of the mandrel.

5. The wellbore isolation device of claim 1, wherein the one or more solid sealing elements comprise:

a center element;

one or more downward facing elements; and one or more upward facing elements, wherein the one or more downward facing elements and the one or more upward facing elements are frustoconical in shape.

6. The wellbore isolation device of claim 1, wherein the center element exhibits an A-shaped cross-section or a V-shaped cross-section.

7. The wellbore isolation device of claim 1, wherein the one or more solid sealing elements comprise at least one sealing element that exhibits a reduced thickness section.

8. The wellbore isolation device of claim 1, wherein the one or more solid sealing elements exhibit a cross-sectional shape selected from the group consisting of A-shaped elements, V-shaped elements, C-shaped elements, O-shaped elements, K-shaped elements, and any combination thereof.

9. The wellbore isolation device of claim 1, wherein the one or more solid sealing elements provide a bi-directional seal against the inner wall of the casing or the wellbore.

10. The wellbore isolation device of claim 1, wherein the one or more solid sealing elements provide a uni-directional seal against the inner wall of the casing or the wellbore.

11. The wellbore isolation device of claim 1, wherein the mandrel is made of a degradable material selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof.

12. The wellbore isolation device of claim 1, further comprising a sheath disposed on all or a portion of at least one of the one or more solid sealing elements, the sheath being a material selected from the group consisting of a TEFLON.RTM. coating, a wax, an elastomer, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, an electrochemical coating and any combination thereof.

13. The wellbore isolation device of claim 1, further comprising a thin piece of rubber or plastic positioned between adjacent sealing elements of the one or more solid sealing elements.

14. A method, comprising: introducing a wellbore isolation device into a wellbore, the wellbore isolation device including a mandrel, one or more solid sealing elements disposed about the mandrel, a slip wedge disposed about the mandrel on a first axial end of the one or more solid sealing elements, and a radial shoulder positioned on the mandrel at a second axial end of the one or more sealing elements, wherein the one or more solid sealing elements are made of a solution-structured galvanic material of magnesium alloy that includes at least one of zinc, aluminum, nickel, copper, and rare earth elements; providing a compressive force on the one or more solid sealing elements with at least the slip wedge; plastically deforming the one or more solid sealing elements into sealing engagement with an inner wall the wellbore or an inner wall of a casing positioned within the wellbore; sealing the wellbore with the one or more solid sealing elements; degrading the mandrel; and degrading the one or more solid sealing elements with the galvanic coupling.

15. The method of claim 14, wherein the wellbore isolation device is a device selected from the group consisting of a frac plug, a bridge plug, a wellbore packer, an open hole packer, a wiper plug, a cement plug, and any combination thereof.

16. The method of claim 14, wherein sealing the wellbore with the one or more solid sealing elements comprises providing a bi-directional seal within the wellbore.

17. The method of claim 14, wherein sealing the wellbore with the one or more solid sealing elements comprises providing a uni-directional seal within the wellbore.

18. The method of claim 14, wherein the mandrel is made of a degradable material, wherein:

degrading the one or more solid sealing elements is at a first degradation rate; and degrading the mandrel is at a second degradation rate that is faster than the first degradation rate, the degradable material of the mandrel being selected from the group consisting of borate glass, polyglycolic acid, polylactic acid, a degradable polymer, a degradable rubber, a galvanically-corrodible metal, a dehydrated salt, a dissolvable metal, a blend of dissimilar metals that generates a galvanic coupling, and any combination thereof.

* * * * *